US010454227B1

(12) United States Patent
Liu et al.

(10) Patent No.: US 10,454,227 B1
(45) Date of Patent: Oct. 22, 2019

(54) SOCKET CONNECTOR

(71) Applicant: Cheng Uei Precision Industry Co., Ltd., New Taipei (TW)

(72) Inventors: Bo Liu, Dong-Guan (CN); Fang-Jin Lou, Dong-Guan (CN); Feng Zhu, Dong-Guan (CN)

(73) Assignee: CHENG UEI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 16/009,245

(22) Filed: Jun. 15, 2018

(51) Int. Cl.

| | |
|---|---|
| ***H01R 24/64*** | (2011.01) |
| ***H01R 13/703*** | (2006.01) |
| ***H01R 13/71*** | (2006.01) |
| ***H01R 13/6597*** | (2011.01) |
| ***H01R 13/627*** | (2006.01) |

(52) U.S. Cl.
CPC ..... *H01R 24/64* (2013.01); *H01R 13/6272* (2013.01); *H01R 13/6597* (2013.01); *H01R 13/703* (2013.01); *H01R 13/71* (2013.01)

(58) Field of Classification Search
CPC ..... H01R 24/64; H01R 13/6272; H01R 13/6597; H01R 13/703; H01R 13/71
See application file for complete search history.

(56) References Cited

U.S. PATENT DOCUMENTS

| | | | | |
|---|---|---|---|---|
| 6,533,615 | B2 * | 3/2003 | Koide | H01R 13/6582 439/607.48 |
| 7,249,961 | B1 * | 7/2007 | Provenzano | H01R 4/2404 439/409 |
| 7,611,383 | B1 * | 11/2009 | Huang | H01R 13/6658 439/620.17 |
| 10,103,477 | B1 * | 10/2018 | Hsieh | H01R 13/521 |
| 10,164,375 | B1 * | 12/2018 | Xie | H01R 13/6583 |
| 2005/0277335 | A1 * | 12/2005 | Gordon | H01R 13/6589 439/607.48 |
| 2009/0111331 | A1 * | 4/2009 | Aronson | H01R 27/00 439/680 |
| 2010/0227486 | A1 * | 9/2010 | Lin | H01R 13/447 439/144 |
| 2014/0370761 | A1 * | 12/2014 | Yu | H01R 13/405 439/676 |
| 2018/0090869 | A1 * | 3/2018 | Williams | H01R 13/44 |

* cited by examiner

*Primary Examiner* — Truc T Nguyen
(74) *Attorney, Agent, or Firm* — Cheng-Ju Chiang

(57) ABSTRACT

A socket connector includes an insulating housing, a sliding block, a resilient element, a detection terminal assembly assembled to a rear end of the insulating housing, a connection terminal assembly assembled to the rear end of the insulating housing, at least one ground element, and an outer shell surrounding the insulating housing. A top of the insulating housing has a restricting groove. A rear of the restricting groove extends rearward to form a sliding groove. At least one side surface of the insulating housing is recessed inward to form at least one ground groove. A rear of a bottom of connecting space extends downward and rearward to form a holding groove. The sliding block is mounted in the sliding groove. The at least one ground element is received in the at least one ground groove. The resilient element is assembled to a top of the insulating housing.

18 Claims, 7 Drawing Sheets

SOCKET CONNECTOR

BACKGROUND OF THE INVENTION

1. Field of the Invention

The present invention generally relates to a connector, and more particularly to a socket connector having a detecting function.

2. The Related Art

Generally, a conventional socket connector includes a plurality of contact elements, an insulating housing and an outer shell. Each of the plurality of the contact elements is a key component of the conventional socket connector completing an electrical connection function. A function of the insulating housing is to make the plurality of the contact elements arranged according to needed positions and intervals, and ensure insulating performance among the plurality of the contact elements, and insulating performance among the plurality of the contact elements and the outer shell. The outer shell is an encloser of the conventional socket connector for providing mechanical protections of the insulating housing and the plurality of the contact elements assembled inside the conventional socket connector and providing an alignment of the conventional socket connector and a plug connector of an equipment when the plug connector is inserted into the conventional socket connector, so that the conventional socket connector is fastened to the equipment.

However, with developments of sciences and technologies, big data evolutions, a more stable and faster transmission capacity is needed in data transmission, the above-mentioned conventional socket connector just has a transmission function that makes the conventional socket connector has no way of dealing with needs of times.

Thus, in order to solve the above-mentioned problems, an innovative socket connector is essential to be provided to make the innovative socket connector capable of carrying a new component for increasing a function of the innovative socket connector, so that a more stable and faster transmission capacity is achieved.

SUMMARY OF THE INVENTION

An object of the present invention is to provide a socket connector adapted for receiving a plug connector. The socket connector has a detecting function. The plug connector includes a plurality of first docking terminals. The socket connector includes an insulating housing, a sliding block, a resilient element, a detection terminal assembly, a connection terminal assembly, at least one ground element, and an outer shell surrounding the insulating housing. An inside of the insulating housing has a connecting space penetrating through a front surface of the insulating housing. A top of the insulating housing has a restricting groove located above the connecting space. A rear of the restricting groove extends rearward to form a sliding groove. A rear of the insulating housing defines a first fastening groove penetrating through a rear of a top surface and a top of a rear surface of the insulating housing. The first fastening groove is located behind and communicated with the sliding groove. At least one side surface of the insulating housing is recessed inward towards a center of the insulating housing to form at least one ground groove. A rear of a bottom of connecting space extends downward and rearward to form a holding groove. The sliding block is mounted in the sliding groove. The connection terminal assembly is assembled to the rear end of the insulating housing. The resilient element is assembled to the top of the insulating housing. The resilient element elastically abuts against a top of the sliding block. The sliding block is capable of elastically sliding upward and downward under a forward pushing force of the plug connector. The detection terminal assembly is assembled to a rear end of the insulating housing and corresponding to the sliding block. The detection terminal assembly includes a plurality of detection terminals. The plurality of the detection terminals are exposed outside by virtue of the sliding block moving upward to further make the plurality of the first docking terminals contact with the plurality of the detection terminals. The at least one ground element is received in the at least one ground groove.

As described above, comparing the socket connector with the conventional socket connector, the plurality of the detection terminals and the at least one ground element are increased, the sliding block controls the plurality of the detection terminals to contact with or be separated from the plurality of the first docking terminals by virtue of a switch structure which is formed by the sliding block cooperating with the resilient element, so the socket connector has the detecting function. Furthermore, the plurality of the detection terminals cooperate with a plurality of connection terminals of the connection terminal assembly for ensuring that the plurality of the connection terminals contact a plurality of second docking terminals and increasing a transmission efficiency of the socket connector, an anti-interference of the socket connector in a transmission process is increased by virtue of the at least one ground element and a stability of the socket connector and the docking plug connector being transmitted mutually. A protecting cover of the socket connector has a characteristic of holding the socket connector to make the socket connector be protected properly in transportation and manufacturing processes. As a result, a more stable and faster transmission capacity of the socket connector is achieved.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
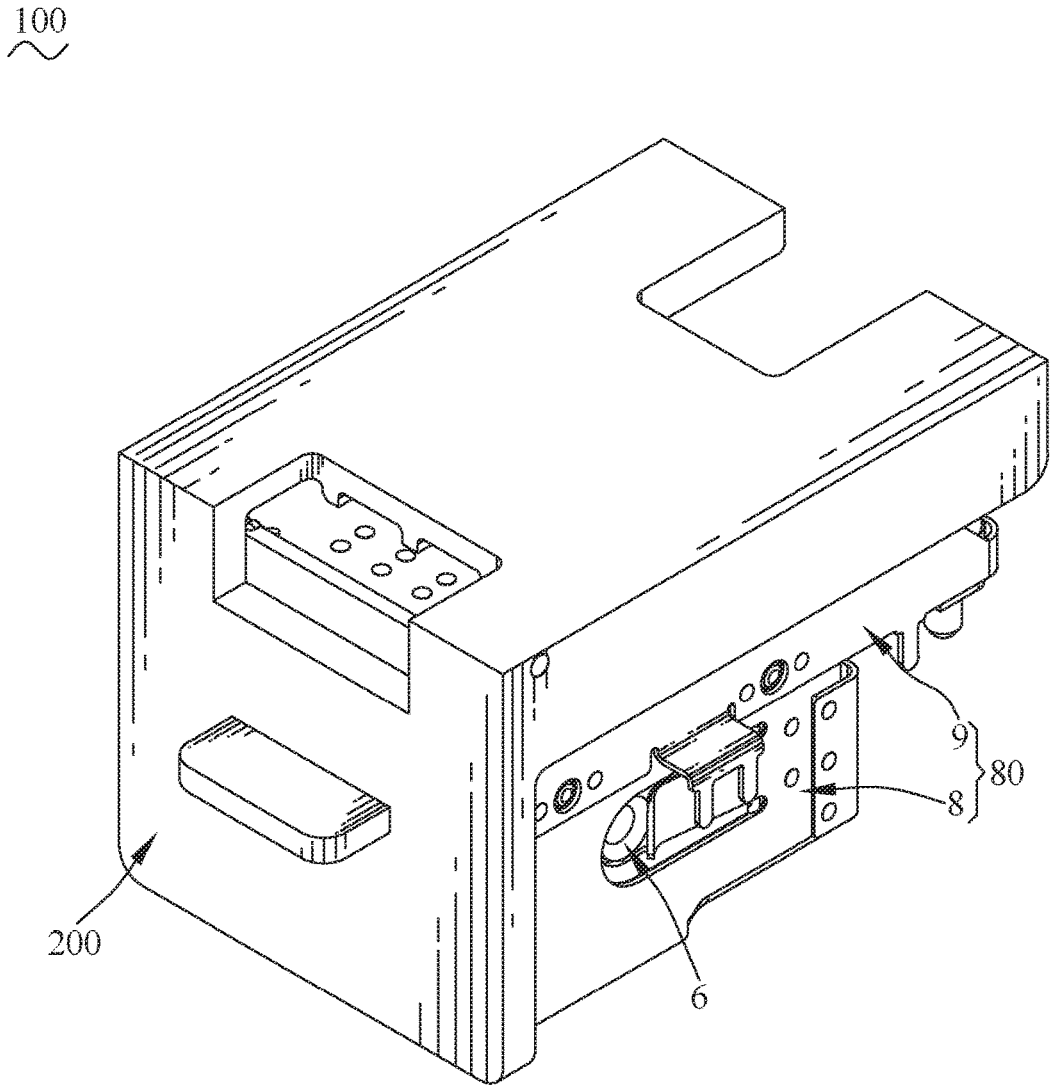
FIG. 1 is a perspective view of a socket connector in accordance with a preferred embodiment of the present invention.
Figure 2:
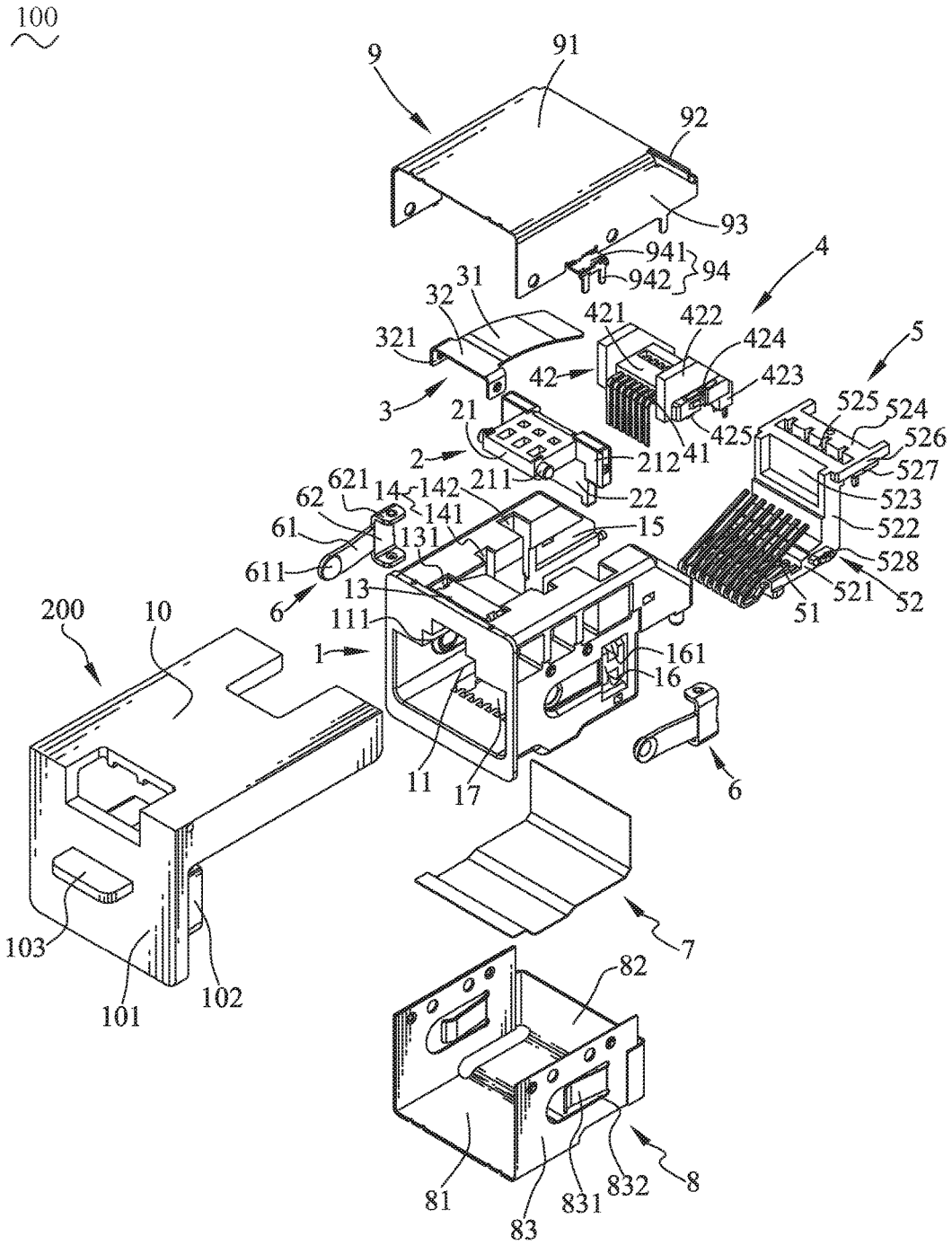
FIG. 2 is an exploded view of the socket connector of FIG. 1.
Figure 6:
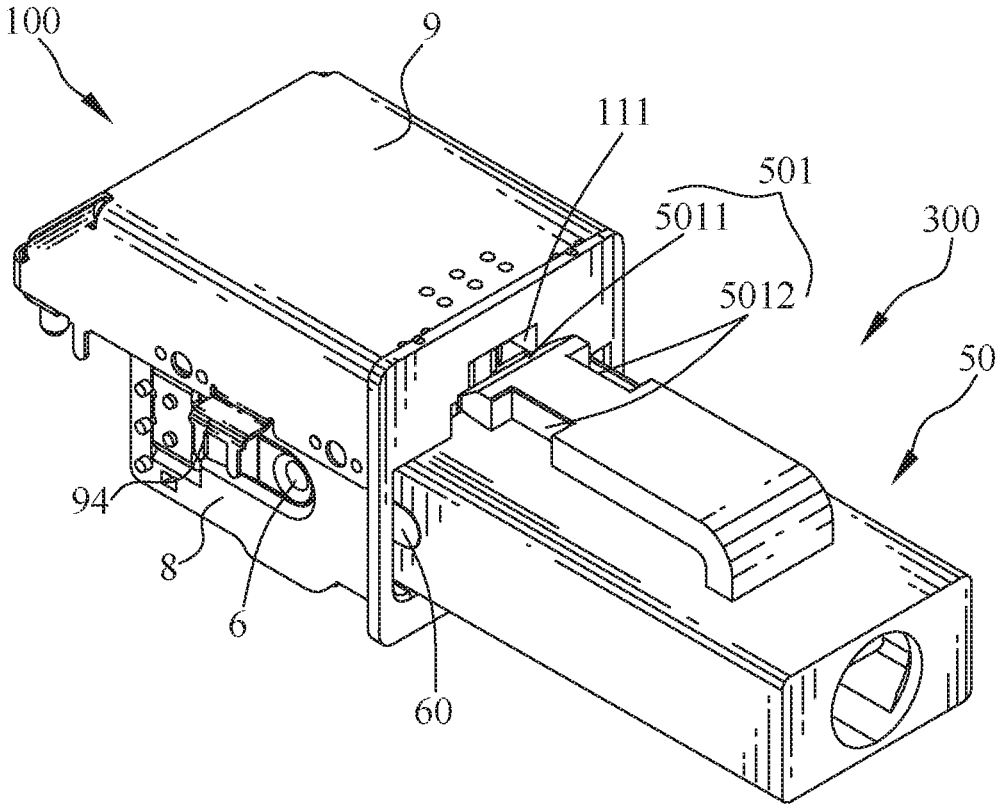
FIG. 6 is a perspective view of the plug connector and the socket connector, wherein the plug connector is matched with the socket connector in accordance with the present invention.

With reference to FIG. 1, FIG. 2 and FIG. 6, a socket connector 100 in accordance with a preferred embodiment of the present invention is shown. The socket connector 100 adapted for receiving a docking plug connector 300, includes an insulating housing 1, a sliding block 2, a resilient element 3, a detection terminal assembly 4, a connection terminal assembly 5, at least one ground element 6, an insulation tape 7, an outer shell 80 and a protecting cover 200. The outer shell 80 includes a lower shell 8 and an upper shell 9. In the preferred embodiment, the socket connector 100 includes two ground elements 6.

Referring to FIG. 2 to FIG. 6, an inside of the insulating housing 1 has a connecting space 11 penetrating through a middle of a front surface of the insulating housing 1 for inserting the docking plug connector 300 therein. A top of the insulating housing 1 has a restricting groove 13 located above the connecting space 11. The restricting groove 13 is recessed downward from a top surface of the insulating housing 1. Two opposite sides of a bottom wall of the restricting groove 13 are recessed downward to form two fastening slots 131, respectively. A rear of the restricting groove 13 extends rearward to form a sliding groove 14. A rear of the connecting space 11 extends upward and rearward to form the sliding groove 14 penetrating through a rear of the top surface and a top of a rear surface of the insulating housing 1. A rear of the insulating housing 1 defines a first fastening groove 15 penetrating through the rear of the top surface and the top of the rear surface of the insulating housing 1. The first fastening groove 15 is located behind and communicated with the sliding groove 14. Each side of the top of the insulating housing 1 defines a first limiting groove 141 and a second limiting groove 142, and the first limiting groove 141 and the second limiting groove 142 are arranged in sequence and along an anterior-posterior direction. Fronts of two inner surfaces of two side walls of the sliding groove 14 are recessed oppositely to form two first limiting grooves 141. Rears of the two inner surfaces of the two side walls of the sliding groove 14 are recessed oppositely to form two second limiting grooves 142 located behind the two first limiting grooves 141, respectively.

The connecting space 11 is covered under the restricting groove 13 and the sliding groove 14 of the top of the insulating housing 1, and the first fastening groove 15 of the rear of the insulating housing 1 to be formed in a middle of the insulating housing 1. A front of an inner surface of a top wall of the connecting space 11 is recessed upward to form an inverted T-shaped recess 111. At least one side surface of the insulating housing 1 is recessed inward towards a center of the insulating housing 1 to form at least one ground groove 16. Two sides of the at least one ground groove 16 are recessed inward to form two insertion slots 161. Two side surfaces of the insulating housing 1 are recessed inward towards the center of the insulating housing 1 to form two ground grooves 16. Two sides of each of the two ground grooves 16 are recessed inward to form the two insertion slots 161. The connecting space 11 is located between the two ground grooves 16. A rear of a bottom of connecting space 11 extends downward and rearward to form a holding groove 17 communicated with an outside of the insulating housing 1. The holding groove 17 penetrates through a rear of a bottom wall and a bottom of a rear wall of the connecting space 11. The rear wall of the connecting space 11 defines a plurality of first fixing slots 171 penetrating downward through the rear wall of the connecting space 11. The bottom wall of the connecting space 11 defines a plurality of second fixing slots 172 penetrating rearward through the bottom wall of the connecting space 11. The holding groove 17 is located under and communicated with the connecting space 11. Rear ends of two side walls of the holding groove 17 are recessed oppositely to form two second fastening grooves 173.

Referring to FIG. 2 to FIG. 6 again, the sliding block 2 is mounted in the sliding groove 14 of the top of the insulating housing 1. The sliding block 2 includes a base body 21 disposed horizontally, and a blocking board 22 perpendicularly extended downward from a rear end of the base body 21. Two opposite side surfaces of a front end of the base body 21 protrude oppositely to form two first sliding portions 211 respectively. The two first sliding portions 211 are of cylinder shapes. Two opposite sides of an upper end of the blocking board 22 extend oppositely to form two second sliding portions 212 respectively. The two first sliding portions 211 are limited in the two first limiting grooves 141 of the top of the insulating housing 1 respectively, and the two second sliding portions 212 are limited in the two second limiting grooves 142 of the top of the insulating housing 1 respectively, so that the sliding block 2 is assembled in the sliding groove 14 of the insulating housing 1. The sliding block 2 is capable of sliding upward and downward under a forward pushing force of the plug connector 300.

Then the resilient element 3 is assembled to the top of the insulating housing 1. The resilient element 3 elastically abuts against a top of the sliding block 2. The resilient element 3 has a rectangular restricting piece 32, and an elastic piece 31 extended rearward and gradually bent downward from a rear of the restricting piece 32. The elastic piece 31 is of a sheet shape, and the elastic piece 31 is made of an elastic material. Two opposite sides of the restricting piece 32 perpendicularly extend downward to form two first fastening portions 321, respectively. The elastic piece 31 is restricted in the restricting groove 13. The two first fastening portions 321 are fastened in the two fastening slots 131 respectively for restricting the elastic piece 31 in the restricting groove 13. When the resilient element 3 is assembled to the insulating housing 1, the elastic piece 31 covers and abuts against the top of the sliding block 2 to make a resilient force of the elastic piece 31 exerted on the sliding block 2.

The detection terminal assembly 4 is assembled to a rear end of the insulating housing 1 and corresponding to the sliding block 2. The blocking board 22 is corresponding to and located in front of the detection terminal assembly 4. The detection terminal assembly 4 includes a first fastening element 42, and a plurality of detection terminals 41 integrally molded to the first fastening element 42. Each of the plurality of the detection terminals 41 has a first fastening section 412, a first contact section 411 perpendicularly extended downward from one end of the first fastening section 412, and a first connecting section 413 slantwise extended rearward and downward, and then extended downward from the other end of the first fastening section 412.

The first fastening element 42 has a first base portion 421 integrally injection-molded around a middle of the first fastening section 412, two first side boards 422 extended outward and then spread outward from two sides of the first base portion 421, and a first connecting board 423 slantwise extended rearward and downward, and then extended downward from a rear of the first base portion 421. The first connecting board 423 is partially molded around the first connecting section 413. Lower portions of outer surfaces of the two first side boards 422 extend outward to form two second fastening portions 424. Bottom surfaces of the two second fastening portions 424 protrude downward to form two first fastening blocks 425, respectively. The two first fastening blocks 425 are connected with bottom surfaces of the two first side boards 422, respectively.

The connection terminal assembly 5 is assembled to the rear end of the insulating housing 1. The connection terminal assembly 5 includes a second fastening element 52, and a plurality of connection terminals 51 integrally molded to the second fastening element 52. Each of the plurality of the connection terminals 51 has a second fastening section 512, a second contact section 511 slantwise extended upward and rearward from a front end of the second fastening section 512, and a third fastening section 513 perpendicularly extended upward from a rear end of the second fastening section 512. A free end of the third fastening section 513 extends rearward and then extends downward to form a second connecting section 514.

The second fastening element 52 has a second base portion 521 integrally injection-molded around a rear of the second fastening section 512. Two opposite side surfaces of the second base portion 521 protrude oppositely to form two second fastening blocks 528. A rear end of the second base portion 521 extends upward to form a supporting portion 522. The supporting portion 522 is molded around the third fastening section 513. A top of the supporting portion 522 defines a first accommodating groove 523. A top of the supporting portion 522 extends rearward to form a fastening holder 524. The fastening holder 524 defines a second accommodating groove 525 vertically penetrating through the fastening holder 524. Two sides of the fastening holder 524 extend oppositely to form two third fastening portions 526, respectively. A bottom surface of the fastening holder 524 extends downward to form a second connecting portion 527. The second connecting portion 527 is partially molded around the second connecting section 514 of each of the plurality of the connection terminals 51.

The at least one ground element 6 is received in the at least one ground groove 16. Specifically, the two ground elements 6 are received in the two ground grooves 16, respectively. The at least one ground element 6 has a main plate 62, and a base plate 61 extended frontward from a middle of a front of the main plate 62. An inner surface of a front end of the base plate 61 of the at least one ground element 6 is arched inward towards the insulating housing 1 to form a touching portion 611. Two sides of the main plate 62 are bent inward towards the insulating housing 1 to form two fourth fastening portions 621. The two fourth fastening portions 621 of the at least one ground element 6 are inserted into the two insertion slots 161, respectively.

After the connection terminal assembly 5 is assembled to the insulating housing 1, the insulation tape 7 is adhered to lower portions of the insulating housing 1 and the connection terminal assembly 5 which are assembled.

Figure 3:
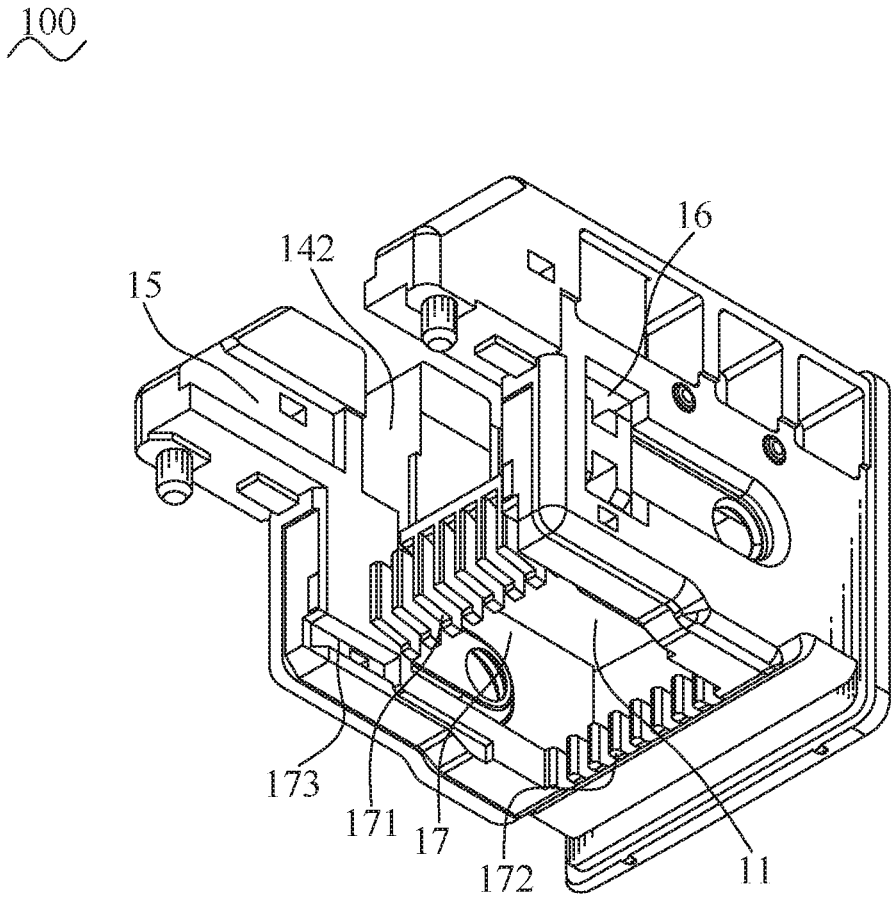
FIG. 3 is a perspective view showing an insulating housing of the socket connector of FIG. 2.

Referring to FIG. 1 to FIG. 4 again, the outer shell 80 surrounds the insulating housing 1 together with the sliding block 2, the resilient element 3, the detection terminal assembly 4, the connection terminal assembly 5, the at least one ground element 6 and the insulation tape 7. The lower shell 8 surrounds a lower portion of the insulating housing 1 along a bottom-to-top direction. The plurality of the connection terminals 51 of the connection terminal assembly 5 are isolated from the lower shell 8 of the outer shell 80 by the insulation tape 7 for preventing the plurality of the connection terminals 51 of the connection terminal assembly 5 from contacting with the lower shell 8 of the outer shell 80 to be conductive. The lower shell 8 includes a bottom plate 81, a first rear plate 82 extended upward from a rear end of the bottom plate 81, and two first lateral plates 83 extended upward from two sides of the bottom plate 81. The two first lateral plates 83 are assembled to two sides of the insulating housing 1 corresponding to the two ground elements 6, respectively. Middles of the two first lateral plates 83 are punched inward towards each other to form two abutting portions 831 corresponding to the two ground elements 6. The two first lateral plates 83 open two openings 832, respectively. Rear walls of the two openings 832 slantwise extend inward towards each other and then are arched inward to form the two abutting portions 831. The two abutting portions 831 abut against the two ground elements 6 to make the two ground elements 6 reach ground functions.

The upper shell 9 surrounds an upper portion of the insulating housing 1 and an upper portion of the lower shell 8 along a top-to-bottom direction. The upper shell 9 is soldered with the lower shell 8 by a spot soldering way to make the upper shell 9 and the lower shell 8 form the complete outer shell 80 surrounding the insulating housing 1. The upper shell 9 includes a top plate 91, a second rear plate 92 slantwise extended downward and rearward from a rear end of the top plate 91, and two second lateral plates 93 extended downward from two sides of the top plate 91. Lower portions of the two second lateral plates 93 are punched outward to form two assembling elements 94. The two assembling elements 94 are used for making the socket connector 100 assembled and cooperated with other components (not shown). The two assembling elements 94 are capable of being arbitrary structures appropriate for the socket connector 100 in accordance with the present invention. In the preferred embodiment, the two assembling elements 94 are disposed beyond outer surfaces of the two second lateral plates 93, respectively. The lower portions of the two second lateral plates 93 extend outward to form two extending plates 941 opposite to each other. Two sides of a free end of each of the two extending plates 941 extend downward to form two elongated assembling plates 942.

Figure 4:
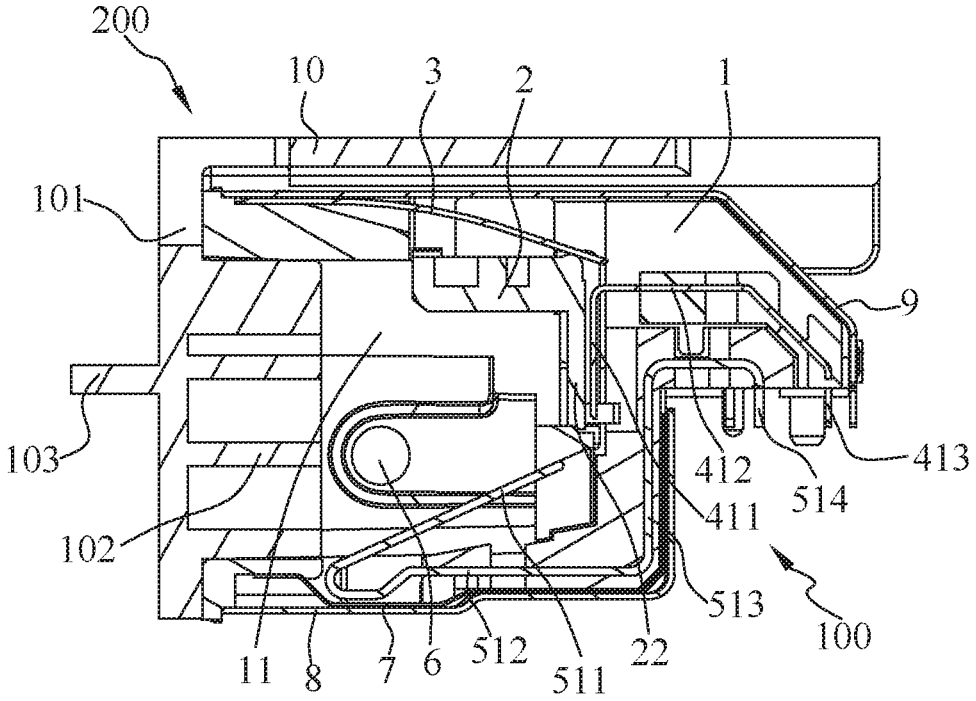
FIG. 4 is a sectional view of the socket connector in accordance with the present invention.

Referring to FIG. 1, FIG. 2 and FIG. 4, when the socket connector 100 is in an unused status, the protecting cover 200 is assembled to and protects the insulating housing 1 together with the outer shell 80. The protecting cover 200 blocks the connecting space 11 of the insulating housing 1. The protecting cover 200 has a top cover 10. A front end of the top cover 10 extends downward to form a front cover 101. A rear surface of the front cover 101 protrudes rearward to form a protecting block 102 corresponding to a position and a shape of the connecting space 11 and projecting into the connecting space 11 of the insulating housing 1. A front surface of the front cover 101 protrudes frontward to form a handle 103.

Referring to FIG. 2 to FIG. 4, when the socket connector 100 is assembled, the sliding block 2, the resilient element 3, the detection terminal assembly 4, the connection terminal assembly 5, the at least one ground element 6, the insulation tape 7, the outer shell 80 and the protecting cover 200 are assembled to the insulating housing 1. After the sliding block 2 and the resilient element 3 are assembled to the insulating housing 1, the two third fastening portions 526 are fastened to substantial middles of inner surfaces of two side walls of the first fastening groove 15. The two second fastening blocks 528 are fastened in the two second fastening grooves 173, respectively. The two second fastening portions 424 are assembled to the substantial middles of the inner surfaces of the two side walls of the first fastening groove 15. The two second fastening portions 424 are connected with and located on the two third fastening portions 526, respectively. The two first fastening blocks 425 are assembled in the second accommodating groove 525. The first contact sections 411 of the plurality of the detection terminals 41 are disposed in the first accommodating groove 523. The blocking board 22 is located in front of the first contact sections 411 of the plurality of the detection terminals 41. The connection terminal assembly 5 is disposed in the holding groove 17.

Then the at least one ground element 6, the insulation tape 7, the outer shell 80 and the protecting cover 200 are mounted to the insulating housing 1. When the protecting cover 200 is assembled to the insulating housing 1 together with the sliding block 2, the resilient element 3, the detection terminal assembly 4, the connection terminal assembly 5, the at least one ground element 6, the insulation tape 7 and the outer shell 80, the protecting block 102 is assembled in the connecting space 11, at the moment, the top cover 10 of the protecting cover 200 is adhered to the upper shell 9 of the socket connector 100 to make the protecting cover 200 integrally hold the socket connector 100, so that in a transportation process of the socket connector 100, an appearance problem of the socket connector 100, including a scratch etc., will be without being caused on account of a waggle of the socket connector 100. In addition, when the socket connector 100 is soldered, the handle 103 of the protecting cover 200 is capable of being clamped directly for preventing the socket connector 100 being contacted directly in a clamping process to cause the appearance problem.

Figure 5:
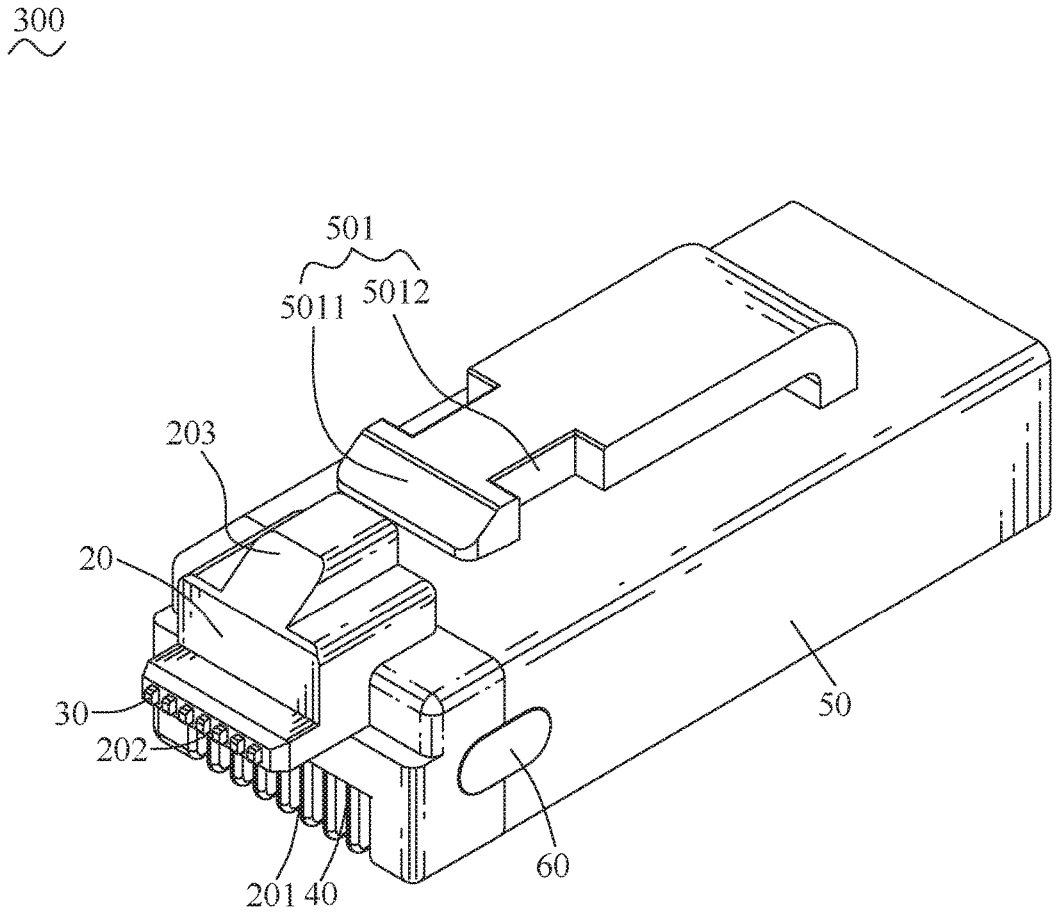
FIG. 5 is a perspective view showing a plug connector for being cooperated with the socket connector in accordance with the present invention.
Figure 7:
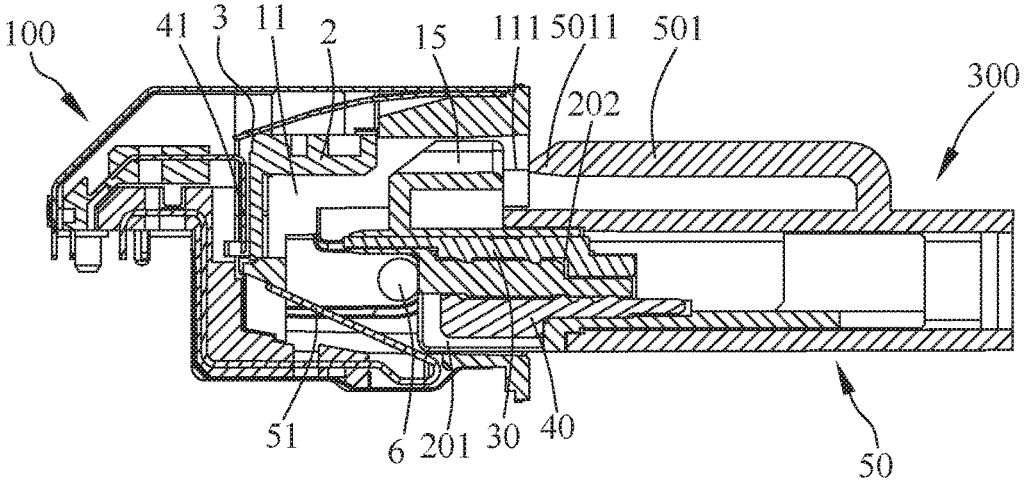
FIG. 7 is a sectional view of the socket connector and the plug connector of FIG. 6, wherein the socket connector is matched with the plug connector.

Referring to FIG. 5 to FIG. 7, the docking plug connector 300 is cooperated with the socket connector 100, the docking plug connector 300 includes a dielectric body 20, a plurality of first docking terminals 30, a plurality of second docking terminals 40, an enclosure 50 and at least one ground area 60. In the preferred embodiment, the docking plug connector 300 includes two ground areas 60. A bottom of a front end of the dielectric body 20 defines a plurality of first docking terminal grooves 201. A middle of the front end of the dielectric body 20 defines a plurality of second docking terminal grooves 202 located above the plurality of the first docking terminal grooves 201. The plurality of the second docking terminal grooves 202 project beyond front ends of the plurality of the first docking terminal grooves 201. A top surface of the front end of the dielectric body 20 protrudes upward to form a protruding portion 203. The plurality of the first docking terminals 30 are assembled in the plurality of the second docking terminal grooves 202 of the dielectric body 20, respectively. The plurality of the second docking terminals 40 are assembled in the plurality of the first docking terminal grooves 201 of the dielectric body 20, respectively. The enclosure 50 encloses and is fastened outside the dielectric body 20. A top of the enclosure 50 protrudes upward and then is bent frontward to form a latch 501. The latch 501 includes a tongue portion 5011. Two sides of a front end of the tongue portion 5011 are recessed inward to form two locking grooves 5012. The at least one ground area 60 is assembled to one side of the dielectric body 20 and is exposed outside. The two ground areas 60 are assembled to two opposite sides of the dielectric body 20 and are exposed outside from two opposite sides of the enclosure 50.

Referring to FIG. 4 to FIG. 7, when the socket connector 100 is docked with the docking plug connector 300, the protruding portion 203 will prop up the sliding block 2 in the connecting space 11 to make the sliding block 2 move upward, the plurality of the detection terminals 41 of the socket connector 100 are exposed outside by virtue of the sliding block 2 moving upward to further make the plurality of the first docking terminals 30 contact with the plurality of the detection terminals 41, so that a conduction is formed between the plurality of the first docking terminals 30 and the plurality of the detection terminals 41. When the docking plug connector 300 keeps being inserted into the connecting space 11 of the socket connector 100, a front end of the tongue portion 5011 will show a pressing status on account of the recess 111. When the docking plug connector 300 keeps being inserted into a bottom of the connecting space 11 of the socket connector 100, two side walls of the recess 111 are locked in the two locking grooves 5012 to make the tongue portion 5011 of the docking plug connector 300 return to an original position on account of an elasticity of a material of the tongue portion 5011. The tongue portion 5011 is buckled in the recess 111. In this way, the docking plug connector 300 is fastened to the socket connector 100. The plurality of the connection terminals 51 contact the plurality of the second docking terminals 40 to make a conduction between the plurality of the connection terminals 51 and the plurality of the second docking terminals 40. The touching portion 611 of the at least one ground element 6 contacts the at least one ground area 60. The two ground elements 6 of the socket connector 100 contact the two ground areas 60 respectively to make a conduction between each of the two ground elements 6 and one of the two ground areas 60.

When the socket connector 100 is withdrawn from the docking plug connector 300, the latch 501 is pressed downward to make the tongue portion 5011 break away from the recess 111 so as to make the tongue portion 5011 pass through the recess 111, at the moment, the plurality of the detection terminals 41 are separated from the plurality of the first docking terminals 30 in advance. When the docking plug connector 300 keeps being withdrawn from the socket connector 100, the plurality of the connection terminals 51 are separated from and disconnected with the plurality of the second docking terminals 40, at the moment, the docking plug connector 300 is withdrawn from the socket connector 100 completely. When the docking plug connector 300 is withdrawn from the socket connector 100 completely, the sliding block 2 is elastically pressed downward to return to an original position by the resilient element 3 of the socket connector 100.

As described above, comparing the socket connector 100 with the conventional socket connector, the plurality of the detection terminals 41 and the at least one ground element 6 are increased, the sliding block 2 controls the plurality of the detection terminals 41 to contact with or be separated from the plurality of the first docking terminals 30 by virtue of a switch structure which is formed by the sliding block 2 cooperating with the resilient element 3, so the socket connector 100 has a detecting function. Furthermore, the plurality of the detection terminals 41 cooperate with the plurality of the connection terminals 51 of the connection terminal assembly 5 for ensuring that the plurality of the connection terminals 51 contact the plurality of the second docking terminals 40 and increasing a transmission efficiency of the socket connector 100, an anti-interference of the socket connector 100 in a transmission process is increased by virtue of the at least one ground element 6 and a stability of the socket connector 100 and the docking plug connector 300 being transmitted mutually. The protecting cover 200 of the socket connector 100 has a characteristic of holding the socket connector 100 to make the socket connector 100 be protected properly in transportation and manufacturing processes. As a result, a more stable and faster transmission capacity of the socket connector 100 is achieved.

What is claimed is:

1. A socket connector adapted for receiving a plug connector, the plug connector including a plurality of first docking terminals, comprising:

an insulating housing, an inside of the insulating housing having a connecting space penetrating through a front surface of the insulating housing, a top of the insulating housing having a restricting groove located above the connecting space, a side of the insulating housing having a sliding groove within the connecting space and open to a rear of the restricting groove, a rear of the insulating housing defining a first fastening groove penetrating through a rear surface of the insulating housing, the first fastening groove being located behind and communicated with the sliding groove, at least one side surface of the insulating housing being recessed inward towards a center of the insulating housing to form at least one ground groove, a rear of a bottom of connecting space extending downward and rearward to form a holding groove, each side of the top of the insulating housing defining a first limiting groove and a second limiting groove, and the first limiting groove and the second limiting groove being arranged in sequence and along an anterior-posterior direction;

a sliding block mounted in the sliding groove;

a resilient element assembled to the top of the insulating housing, the resilient element elastically abutting against a top of the sliding block, the sliding block being capable of elastically sliding upward and downward under a forward pushing force of the plug connector;

a detection terminal assembly assembled to a rear end of the insulating housing and corresponding to the sliding block, the detection terminal assembly including a plurality of detection terminals, the plurality of the detection terminals being exposed outside by virtue of the sliding block moving upward to further make the plurality of the first docking terminals contact with the plurality of the detection terminals;

a connection terminal assembly assembled to the rear end of the insulating housing;

at least one ground element received in the at least one ground groove; and an outer shell surrounding the insulating housing.

2. The socket connector as claimed in claim 1, wherein fronts of two inner surfaces of two side walls of the sliding groove are recessed oppositely to form two first limiting grooves, rears of the two inner surfaces of the two side walls of the sliding groove are recessed oppositely to form two second limiting grooves located behind the two first limiting grooves, respectively, the sliding block includes a base body disposed horizontally, and a blocking board perpendicularly extended downward from a rear end of the base body, two opposite side surfaces of a front end of the base body protrude oppositely to form two first sliding portions respectively, two opposite sides of an upper end of the blocking board extend oppositely to form two second sliding portions respectively, the two first sliding portions are limited in the two first limiting grooves respectively, and the two second sliding portions are limited in the two second limiting grooves respectively.

3. The socket connector as claimed in claim 1, wherein the resilient element has a restricting piece, and an elastic piece extended rearward and gradually bent downward from a rear of the restricting piece, the elastic piece is restricted in the restricting groove, when the resilient element is assembled to the insulating housing, the elastic piece covers and abuts against the top of the sliding block.

4. The socket connector as claimed in claim 3, wherein two opposite sides of a bottom wall of the restricting groove are recessed downward to form two fastening slots, respectively, two opposite sides of the restricting piece perpendicularly extend downward to form two first fastening portions, respectively, the two first fastening portions are fastened in the two fastening slots respectively for restricting the elastic piece in the restricting groove.

5. The socket connector as claimed in claim 3, wherein the elastic piece is of a sheet shape, and the elastic piece is made of an elastic material.

6. The socket connector as claimed in claim 1, wherein the detection terminal assembly includes a first fastening element, and a plurality of detection terminals integrally molded to the first fastening element, each of the plurality of the detection terminals has a first fastening section, a first contact section perpendicularly extended downward from one end of the first fastening section, and a first connecting section slantwise extended rearward and downward, and then extended downward from the other end of the first fastening section, the first fastening element has a first base portion integrally injection-molded around the first fastening section, two first side boards extended outward and then spread outward from two sides of the first base portion, and a first connecting board slantwise extended rearward and downward, and then extended downward from a rear of the first base portion, the first connecting board is partially molded around the first connecting section.

7. The socket connector as claimed in claim 6, wherein the connection terminal assembly includes a second fastening element, and a plurality of connection terminals integrally molded to the second fastening element, each of the plurality of the connection terminals has a second fastening section, a second contact section slantwise extended upward and rearward from a front end of the second fastening section, and a third fastening section perpendicularly extended upward from a rear end of the second fastening section, a free end of the third fastening section extends rearward and then extends downward to form a second connecting section, the second fastening element has a second base portion integrally injection-molded around the second fastening section, a rear end of the second base portion extends upward to form a supporting portion molded around the third fastening section, a top of the supporting portion extends rearward to form a fastening holder, a bottom surface of the fastening holder extends downward to form a second connecting portion molded around the second connecting section of each of the plurality of the connection terminals.

8. The socket connector as claimed in claim 7, wherein two opposite side surfaces of the second base portion protrude oppositely to form two second fastening blocks, a top of the supporting portion defines a first accommodating groove, the fastening holder defines a second accommodating groove vertically penetrating through the fastening holder, two sides of the fastening holder extend oppositely to form two third fastening portions, respectively, lower portions of outer surfaces of the two first side boards extend outward to form two second fastening portions, bottom surfaces of the two second fastening portions protrude downward to form two first fastening blocks, respectively, the two second fastening portions are connected with and located on the two third fastening portions, respectively, the two first fastening blocks are assembled in the second accommodating groove.

9. The socket connector as claimed in claim 8, wherein the two first fastening blocks are connected with bottom surfaces of the two first side boards, respectively.

10. The socket connector as claimed in claim 1, wherein two sides of the at least one ground groove are recessed inward to form two insertion slots, the at least one ground element has a main plate, and a base plate extended frontward from a front of the main plate, two sides of the main plate are bent inward towards the insulating housing to form two fourth fastening portions, the two fourth fastening portions are inserted into the two insertion slots, respectively.

11. The socket connector as claimed in claim 10, wherein an inner surface of a front end of the base plate of the at least one ground element is arched inward towards the insulating housing to form a touching portion, the plug connector includes a dielectric body and at least one ground area, the at least one ground area is assembled to one side of the dielectric body and is exposed outside, the touching portion of the at least one ground element contacts the at least one ground area.

12. The socket connector as claimed in claim 1, further comprising an insulation tape adhered to lower portions of the insulating housing and the connection terminal assembly which are assembled, the connection terminal assembly being isolated from the outer shell by the insulation tape for preventing the connection terminal assembly from contacting with the outer shell to be conductive.

13. The socket connector as claimed in claim 1, wherein the outer shell includes a lower shell and an upper shell, the lower shell surrounds a lower portion of the insulating housing along a bottom-to-top direction, the upper shell surrounds an upper portion of the insulating housing and an upper portion of the lower shell along a top-to-bottom direction.

14. The socket connector as claimed in claim 13, wherein the socket connector includes two ground elements, the lower shell includes a bottom plate, and two first lateral plates extended upward from two sides of the bottom plate, the two first lateral plates are assembled to two sides of the insulating housing, respectively, middles of the two first lateral plates are punched inward towards each other to form two abutting portions corresponding to the two ground elements, the two abutting portions abut against the two ground elements to make the two ground elements reach ground functions.

15. The socket connector as claimed in claim 14, wherein the two first lateral plates open two openings, respectively, rear walls of the two openings slantwise extend inward towards each other and then are arched inward to form the two abutting portions.

16. The socket connector as claimed in claim 13, wherein the upper shell is soldered with the lower shell by a spot soldering way to make the upper shell and the lower shell form the complete outer shell, the upper shell includes a top plate, and two second lateral plates extended downward from two sides of the top plate, lower portions of the two second lateral plates are punched outward to form two assembling elements disposed beyond outer surfaces of the two second lateral plates, respectively, the lower portions of the two second lateral plates extend outward to form two extending plates opposite to each other, two sides of a free end of each of the two extending plates extend downward to form two elongated assembling plates.

17. The socket connector as claimed in claim 1, further comprising a protecting cover, the protecting cover having a top cover, a front end of the top cover extending downward to form a front cover, a rear surface of the front cover protruding rearward to form a protecting block corresponding to a position and a shape of the connecting space and projecting into the connecting space, a front surface of the front cover protruding frontward to form a handle.

18. The socket connector as claimed in claim 1, wherein when the plug connector is withdrawn from the socket connector completely, the sliding block is elastically pressed downward to return to an original position by the resilient element.

* * * * *